US006769154B1

(12) United States Patent
Klein et al.

(10) Patent No.: US 6,769,154 B1
(45) Date of Patent: Aug. 3, 2004

(54) EXTERNAL DOOR HANDLE MAINLY INTENDED FOR VEHICLES

(75) Inventors: Helmut Klein, Velbert (DE); Reinhard Chilla, Velbert (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 27 days.

(21) Appl. No.: 10/031,770

(22) PCT Filed: Jul. 20, 2000

(86) PCT No.: PCT/EP00/06928

§ 371 (c)(1),
(2), (4) Date: Jan. 23, 2002

(87) PCT Pub. No.: WO01/07736

PCT Pub. Date: Feb. 1, 2001

(30) Foreign Application Priority Data

Jul. 27, 1999 (DE) ..... 199 35 290
Sep. 14, 1999 (DE) ..... 299 16 091 U

(51) Int. Cl.[7] ..... A45C 13/22

(52) U.S. Cl. ..... 16/412; 16/413; 16/110.1; 16/111.1

(58) Field of Search ..... 16/412, 413, 110.1, 16/111.1, 421, 422, 440

(56) References Cited

U.S. PATENT DOCUMENTS 5,639,256 A * 6/1997 Endo et al. ..... 439/358
6,007,356 A * 12/1999 Stein ..... 439/284
2003/0001729 A1 * 1/2003 Ieda et al. ..... 340/426

FOREIGN PATENT DOCUMENTS

DE 196 33 894 A1 2/1998
DE 019745149 * 4/1999
DE 197 45 149 A1 4/1999
FR 2819538 * 1/2001
JP 10-297571 * 10/1998
WO 9928170 6/1999

* cited by examiner

*Primary Examiner*—Anthony Knight
*Assistant Examiner*—Mark Williams
(74) *Attorney, Agent, or Firm*—Friedrich Kueffner

(57) ABSTRACT

The present invention relates to an external door handle that comprises a bracket-shaped handle (10) comprising a cavity (14) which is defined by at least one U-shaped shell (21, 22) and which is intended for receiving electronic components (16). The purpose of the present invention is to prevent the formation of a contact joint (18) on the visible side that would promote soil formation. To this end, the shell or shells (21, 22) are coated with a c-shaped front profile (20) on the visible side, wherin the ends (25) of the C-shape profile (20) are brougbt into contact with the upper or lower portions of said shell or (21, 22) at the pile where they are anchored.

12 Claims, 9 Drawing Sheets

EXTERNAL DOOR HANDLE MAINLY INTENDED FOR VEHICLES

BACKGROUND OF THE INVENTION

1. Field of the Invention

The invention relates to an external door handle for vehicles having a handle, arranged on the outer side of the door and being at least partially hollow, wherein the handle comprises at least one U-shaped shell whose U-space serves for receiving the electronic components, and wherein in the connected situation the U-shaped shell is spanned at the visible side by a C-shaped front strip and is anchored thereat.

2. Description of the Related Art

The known handle is provided with a hollow space for receiving electronic components. For this reason, the known handle was configured of two shells comprised of a C-shaped base shell and a C-shaped cover shell connected with the leg ends of the base shell. A disadvantage of such an arrangement is that the terminal snap-on connection of the shells does not provide a sufficient strength for the use as a door handle and that on the front side a contact seam is formed which is visually disruptive because at this visible location manufacturing tolerances that are present become particularly obvious. Moreover, this seam also provides the possibility that dirt can deposit on the front side and that moisture can penetrate into the interior space between the shells so that the components therein are impaired in their function. Also, the embedding of the electronic components in the upright inner shell by means of a synthetic resin is not a permanent solution because the resin will begin to creep over time.

SUMMARY OF THE INVENTION

It is an object of the invention to develop a reliable external door handle of the aforementioned kind which prevents the aforementioned disadvantages and generates an especially good and, if needed, detachable connection between the two shells. This is achieved according to the invention in that the two C-end sections of the front strip engage an additional circumferential area of the U-shaped shell from above or from below and in that the electronic components are encapsulated water-tightly in a carrier open at the top.

The invention however is also of special importance when the handle is comprised of two shells, i.e., a U-shaped base shell and a cover shell between which the hollow space is formed. In this case, the C-shaped front strip acts like a clamp which presses the cover shell against the U-shaped base shell. This clamp-like connection is provided in addition to the usually already present connections between the two shells. In the case of this clamp connection of the two shells the contact seam between the two shells at the visible side is covered in any case. Even though this contact seam is still present, the access of soil or moisture into the interior of the space between the shells is made significantly more difficult. A type of labyrinth course is present. The detachable connection, if needed, is provided as a result of the C-ends snapped into place in the grooves at the top and bottom sides.

A further advantageous configuration is comprised of a U-shaped base shell which in the direction of the front strip to be applied has a U-shaped opening. Into this U-opening the carrier with the electronic components is slipped with precise fit. The front strip snapped into place on the base shell covers in this connection with its front section the U-opening of the base shell with the carrier positioned therein.

The carrier can be embodied as a container of hard plastic material which is open at the top so that from here during manufacture of the handle the electronic device can be inserted into the container. In order to protect the electronic device against sliding and exposure to media (for example, water), it is encapsulated in this container, for example, with a soft plastic material. In this connection, the opening of the container at the top is an advantage because the open top side of the container is planar, and a uniform filling of the container with the potting compound can be realized accordingly.

BRIEF DESCRIPTION OF THE DRAWINGS

Further measures and advantages of the invention result from the dependent claim, the following description, and the drawings. In the drawings, the invention, in the form of two embodiments, and the prior art are illustrated. It is shown in:

DESCRIPTION OF PREFERRED EMBODIMENTS

Figure 1:
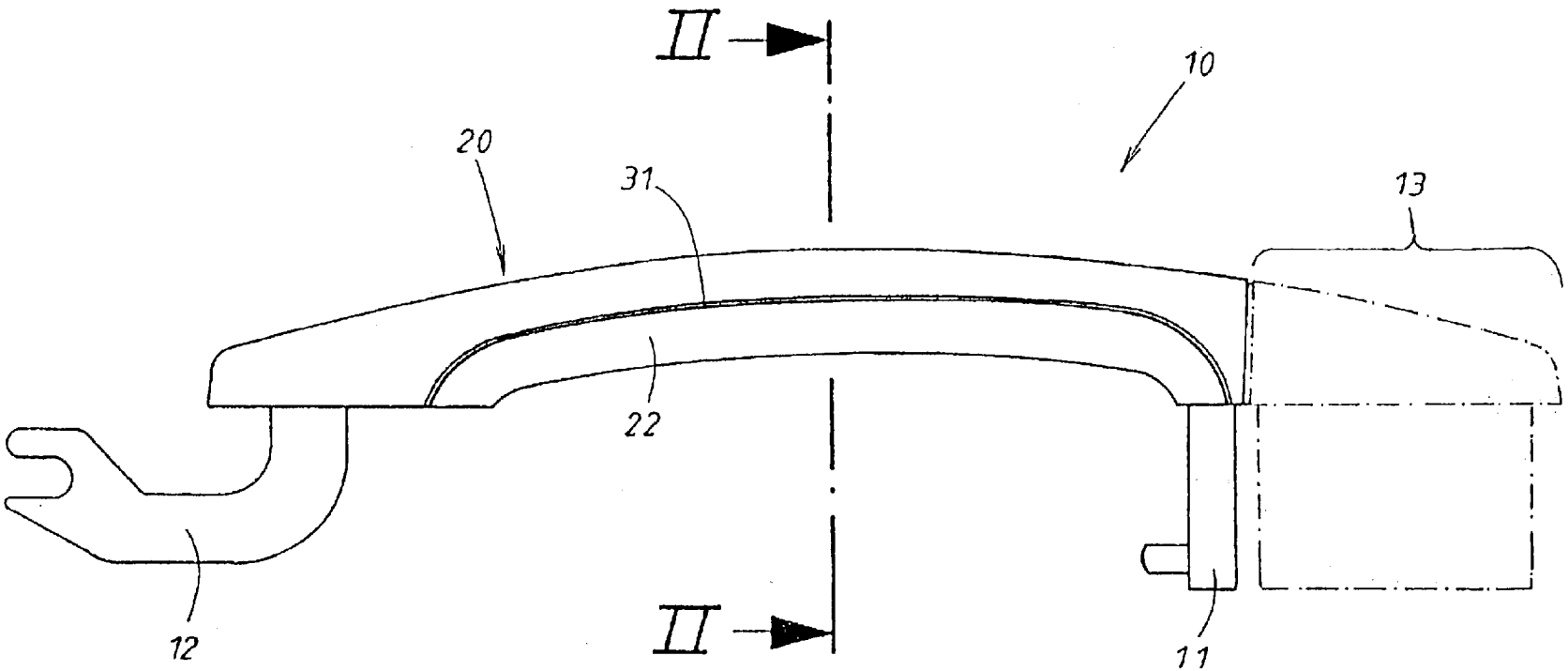
FIG. 1 for a two-shell first embodiment of the invention a plan view onto the handle in the viewing direction of arrow I of FIG. 2.

In the drawings only the bracket-shaped handle 10 of the external door handle appearing on the external side is illustrated. This handle, in the illustrated embodiment a so-called "pull handle", is moveably supported with its two handle ends 11, 12 in a base part, not illustrated in detail. This base part is generally provided on the inner side of the door or of the skin of the door. In addition to the handle 10, as illustrated in dash-dotted lines in FIG. 1, a so-called "cylinder column" is provided in which a closing cylinder can be received, if needed. The cylinder column 13 does not take part in the movement of the handle 10.

Figure 2:
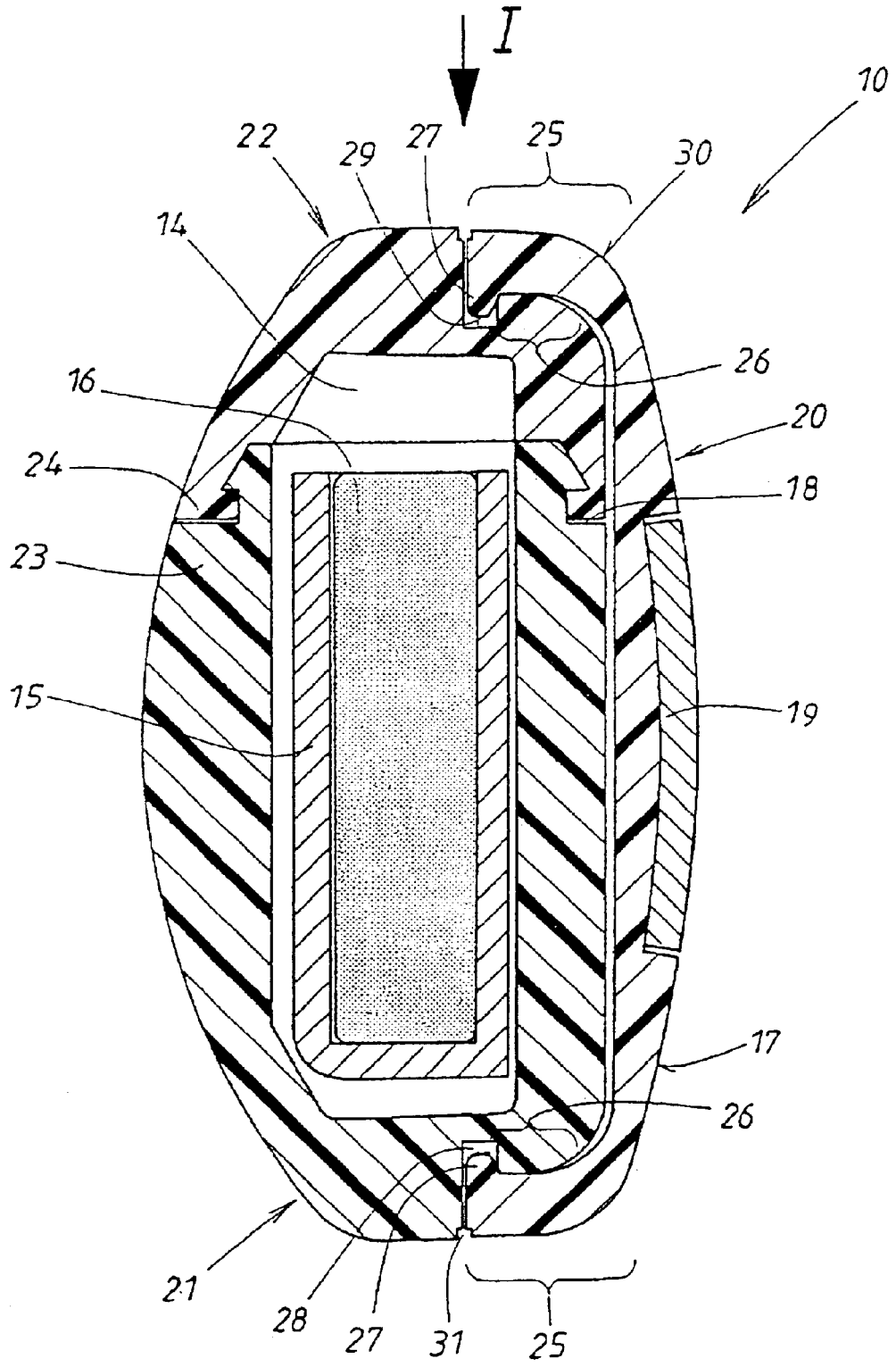
FIG. 2 on a greatly enlarged scale a schematic cross-section of the handle along the section line II—II of FIG. 1.

The handle 10 is provided with a hollow space 14 illustrated in FIG. 2 in which a carrier 15 for electronic components is arranged. The electronic components 16 can be a ferrite rod acting as an antenna. For generating the hollow space 14 and for introducing the electronic components 16 and their carrier 15, the handle 10, as illustrated in the cross-section of FIG. 2, is of a two-shell configuration.

Figure 4:
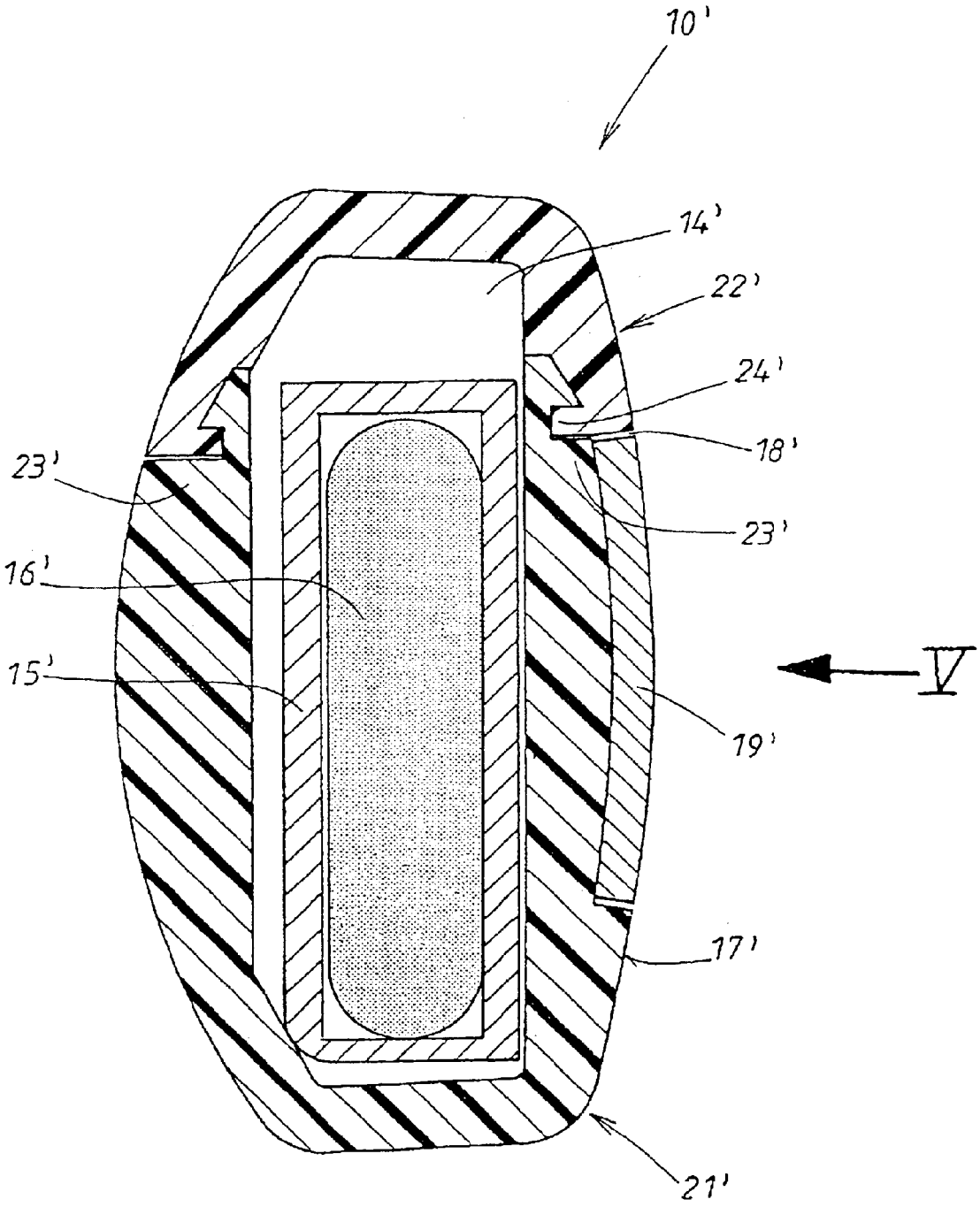
FIG. 4 in a representation corresponding to FIG. 2, the appearance of the known handle along the section line IV—IV of FIG. 5.
Figure 5:
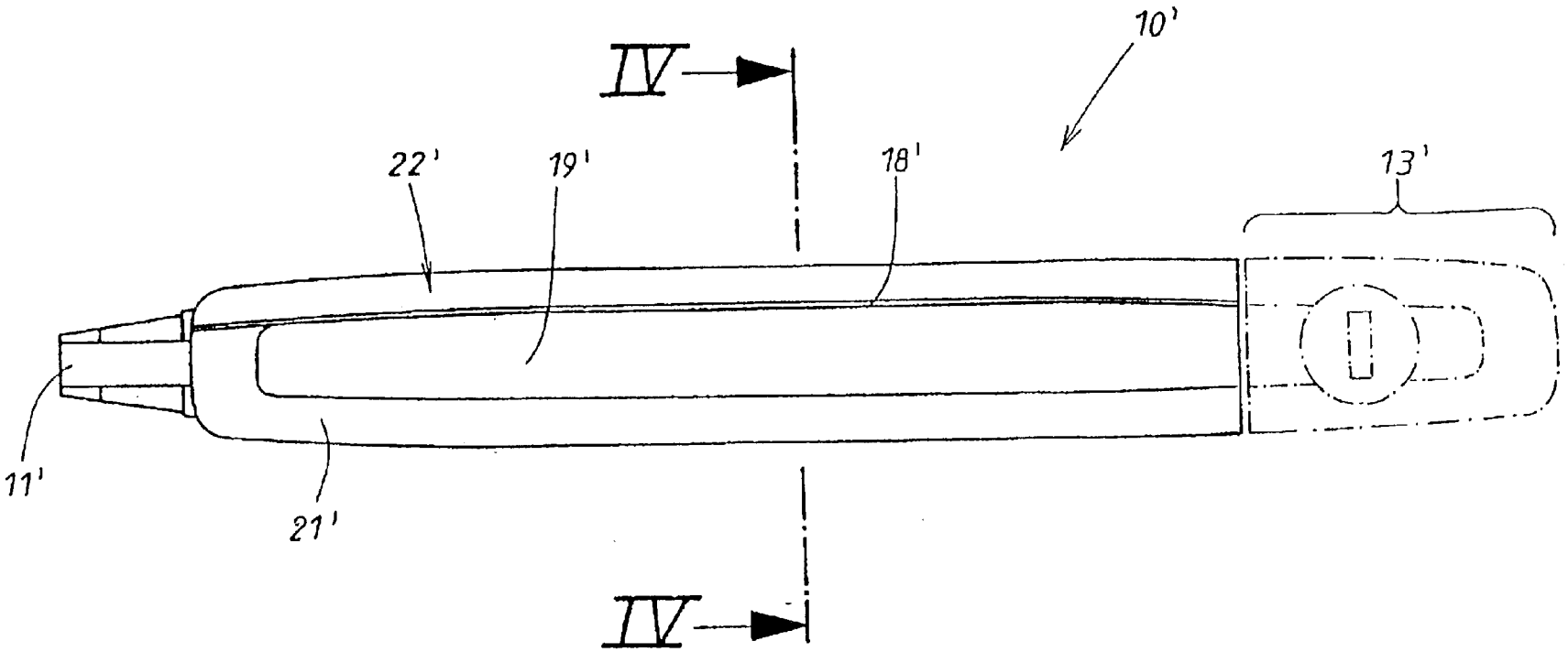
FIG. 5 a front view of the known handle illustrated in FIG. 4 in a viewing direction of numeral V of FIG. 4.

The latter is also true for the prior art which is illustrated in FIGS. 4 and 5. Here, the same reference numerals as in the first embodiment are used for identifying corresponding components but, as a differentiation, they are provided with a prime (apostrophe). The prior art handle 10' is comprised of two shells 21', 22' for producing the prior art hollow space 14'. These include a U-shaped base shell 21' whose two U-legs 23' are connected by means of a cover shell 22'. For this purpose, a snap connection 24' can be provided because both shells 21', 22' are made of plastic material which has a sufficient elasticity. In the connecting situation according to FIGS. 4 and 5 at the visible side 17' of the handle 10 a contact seam 18' results through which moisture or dirt can enter the hollow space 14' via the engaged snap connection 24. The visible side of the handle 10' can be provided with an optionally rrmetallic decorative cover 19'.

The handle 10 according to FIGS. 1 and 2 of the invention has a comparable configuration as regards the above description. The components already described in connection with FIGS. 4 and 5 are provided with corresponding reference numerals, however, without the prime (apostrophe) being added in these figures. Accordingly, the preceding description applies. It is sufficient to only point out the differences.

In the case of the handle 10 according to the invention pursuant to FIGS. 1 and 2, a C-shaped front strip 20 is used which covers the two shells 21, 22 at the visible side. The front strip 20 itself now forms the actual visible side 17 of the handle and covers the contact seam 18. The C-end sections 25 of the front strip 20 cover a circumferential area of the two shells 21, 22 where step-shaped recesses 26 are provided. Finally, the two free C-ends 27 engage an upper and a lower groove 29, 28 where they are arranged in a sunk arrangement. In the connecting situation clamping of the two shells 21, 22 by this front strip 22 is realized.

The aforementioned step 26 on the two shells 21, 22 has a step depth which corresponds approximately to the thickness of the end sections 25 of the front strip 20. This has the result that the handle 10, despite the clamped-on front strip 20, has a substantially projection-free contour 30. The front strip 20, in turn, can be provided with a decorative cover 19. Between the attached front strip 20 and the areas adjoining it and not covered of the two shells 21, 22, a "shadow seam" illustrated in FIGS. 2 and 3 can be provided. This shadow seam 31 only benefits the good appearance of the handle according to the invention. This shadow seam 31 does not entail the risk discussed in connection with the known contact seam 18' of FIG. 3. Moisture penetrating in the area of the shadow seam 31 cannot reach the hollow space 14 of the handle 10 according to the invention because a closed wall is arranged therebetween in the case of both shells 21, 22.

Figure 3:
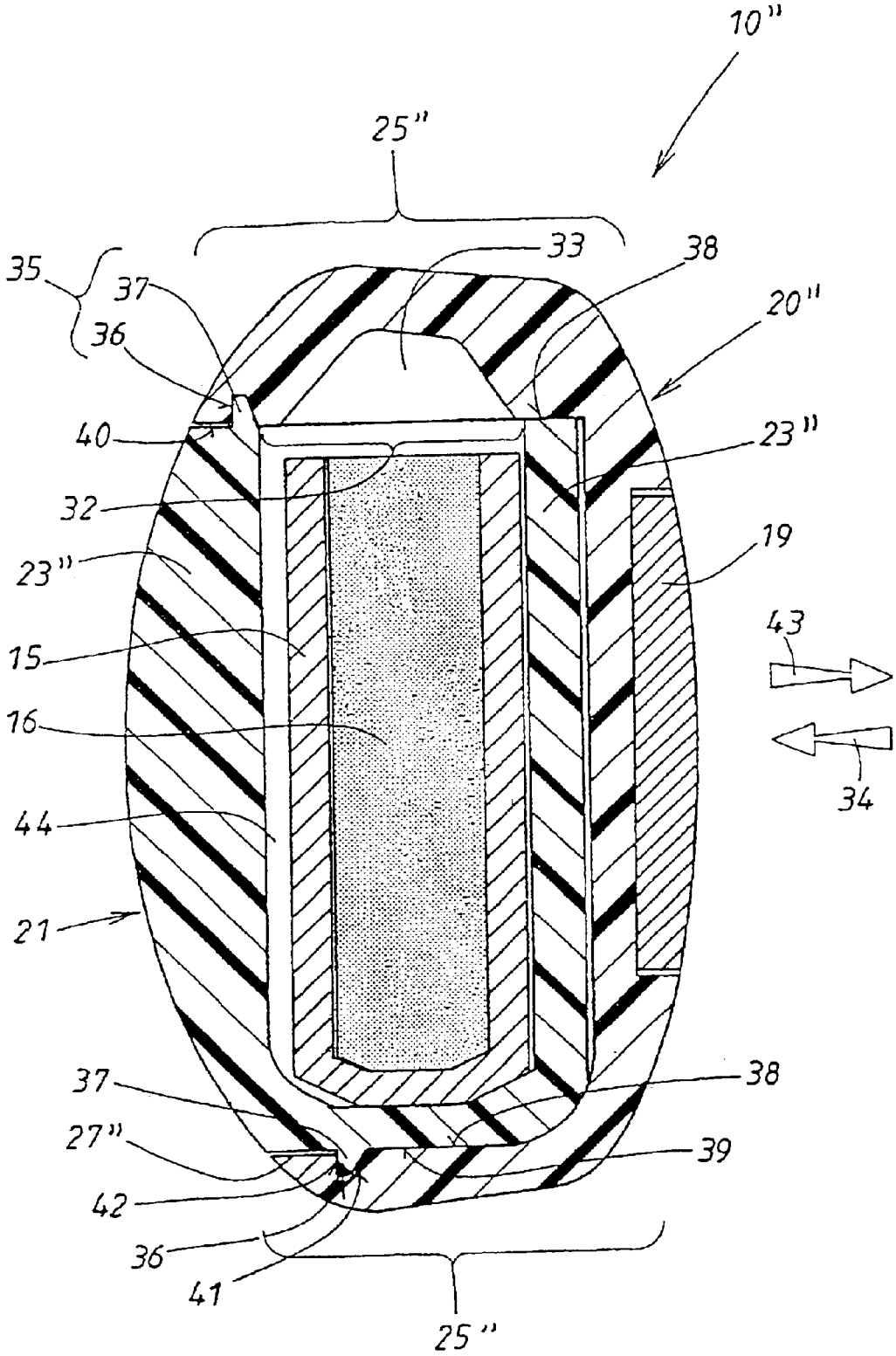
FIG. 3 in a representation corresponding to FIG. 2, a second embodiment of the invention embodied only with a single shell.

FIG. 3 shows a second embodiment of a handle 10" according to the invention which is a space-saving arrangement in comparison to FIG. 2. For referencing analog components, the same reference numerals as in the first embodiment are used so that in this respect the preceding description applies. It is sufficient to point out only the differences.

According to the invention, only a single U-shell 21 is provided whose U-opening 32 between the two U-legs 23" is covered directly by the upper C-end section 25" of the front strip 20" provided thereat. This upper C-end section 25" can also be provided with an inner hollow 33. The two end sections 25" provided here are arranged substantially parallel to one another and enable a sliding mounting of the two components 21, 20" in the direction of the mounting arrow 35 illustrated in FIG. 3. This results in an automatic snap connection 35 which is embodied in the following way.

One snap element 36 is arranged at the inner surface 38 of the end section 25" and is comprised of a tooth recess. The bottom area 39 of the U-shell 21 has a corresponding counter snap element 37 which is formed by a tooth projection. Correspondingly, the outer U-leg 23" of the shell 21 on the handle 10" has such a tooth projection 37 on the leg end 40. In this connection, the elements 37, 38 are profiled in a special way.

Accordingly, the tooth flank active in the sliding direction 34 of the front strip 20" has a leading slant 41 against which the stretched C-end 27" will impact during mounting. This results in a slight spreading of the two C-end sections 25" until the tooth recess 36 snaps onto the tooth projection 37. Detachment of the two components 21, 20" in the direction of the counter movement illustrated in FIG. 3 by the arrow 43 is not possible easily because the oppositely positioned tooth flanks 42 active in this direction are steep. Detachment 43 is thus possible only with a corresponding spreading of the two end sections 25" that are snapped into place.

In the second embodiment of the handle 10" of FIG. 3, the U-space 44 of a single shell 21 is the hollow space for receiving the already described carrier 15 for the electronic components 16. In this case, the bottom area 39 and the two leg ends 40 are without steps and in areal contact with the inner surfaces 38 of the two C-end sections 25".

Figure 6:
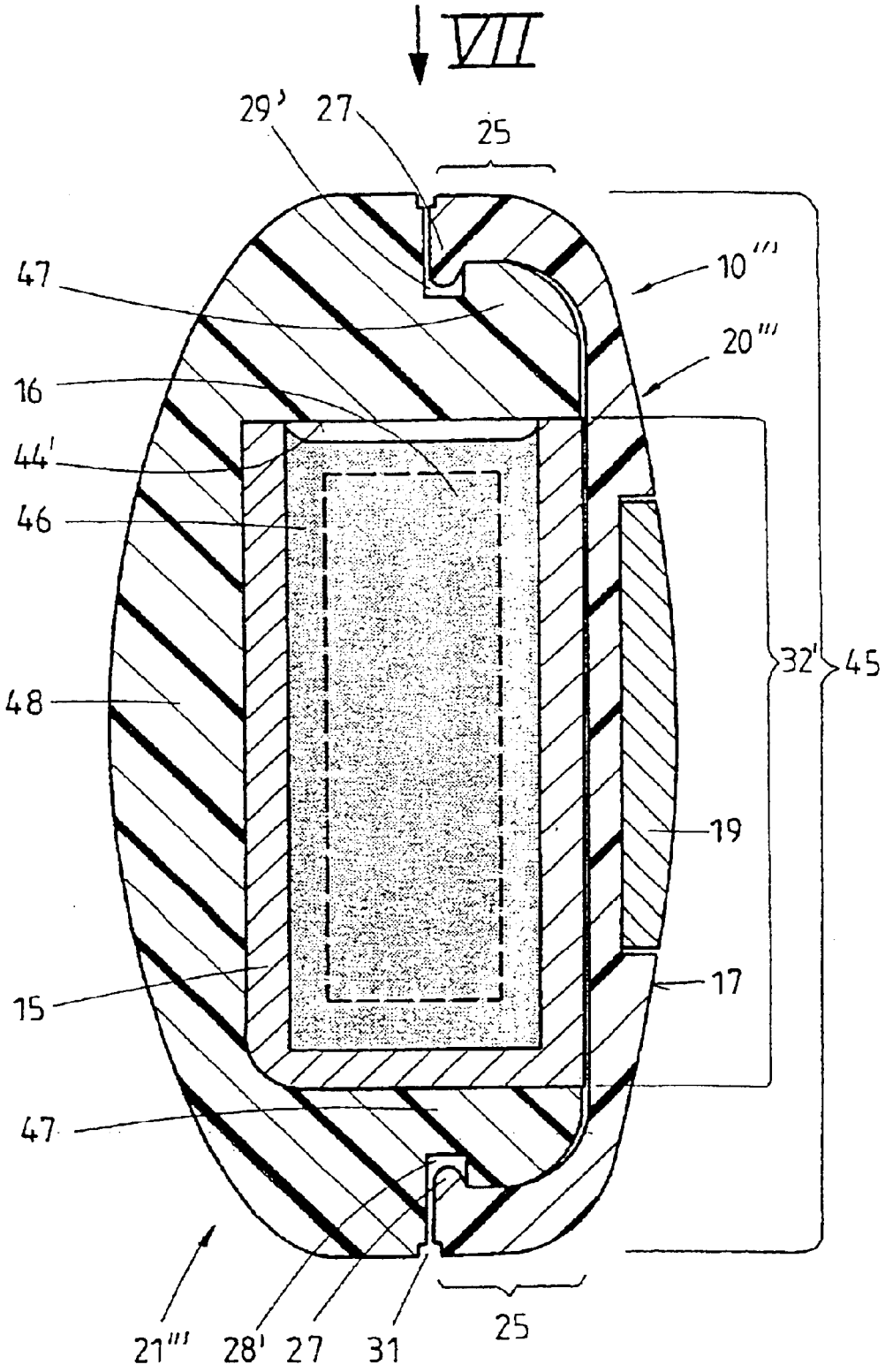
FIG. 6 in a representation corresponding to FIG. 2, a third embodiment of the invention embodied only with a single shell in a section according to VI—VI of FIG. 10.
Figure 10:
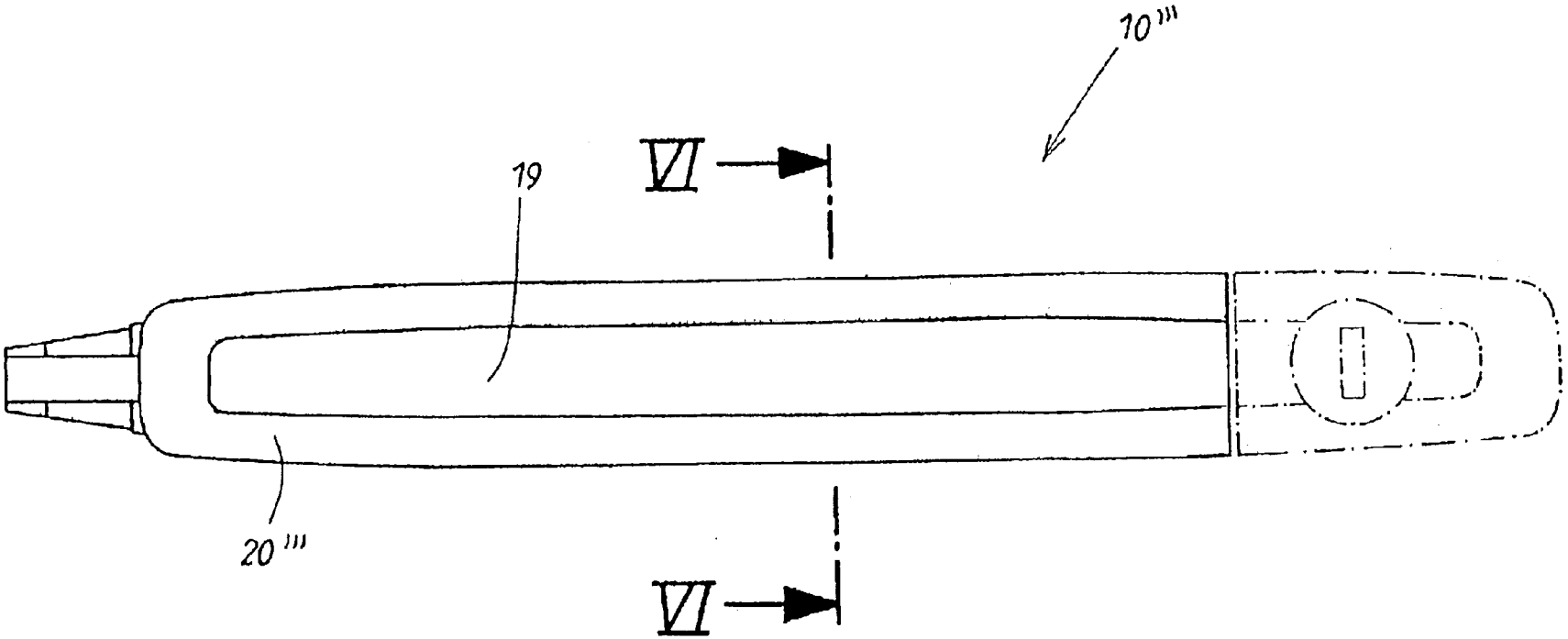
FIG. 10 a front view of the third embodiment of the invention embodied only with a single shell.

In a third embodiment of the handle 10'" according to FIG. 6 and FIG. 10, a base shell 21'" has a transversely positioned U-shaped configuration whose U-opening faces the front strip 20'" provided here. The U-shape is formed of the two legs 47 and the base 48 of the base shell 21'". Between the two legs 47 and the base 48 the U-space 44' is formed into which the carrier 15 formed as a container of hart plastic material can be introduced via the lateral U-opening 32'. In the container 15 the electronic device 16 is encapsulated with a potting compound 46 in a water-tight and impact-proof way. The container 15 is open at the top so that the electronic device during manufacture can be introduced from above into the container and the encapsulation can take place also through the upper open surface of the container. The U-opening 32' of the U-shaped base shell 21'" is covered by the front section 45 of the front strip 20'". This front strip 20'" is secured on the base shell 21'" by means of the hook-shaped C-ends 27 engaging in the upper groove 29' and the bottom groove 28' on the base shell 21'". In this embodiment there is no seam on the visible side 17 of the front strip 20'". The visible shadow seam 31 in this embodiment is instead provided between the C-end sections 25 and the visible outer sides of the legs 47 of the base shell 21'", respectively.

Figure 7:
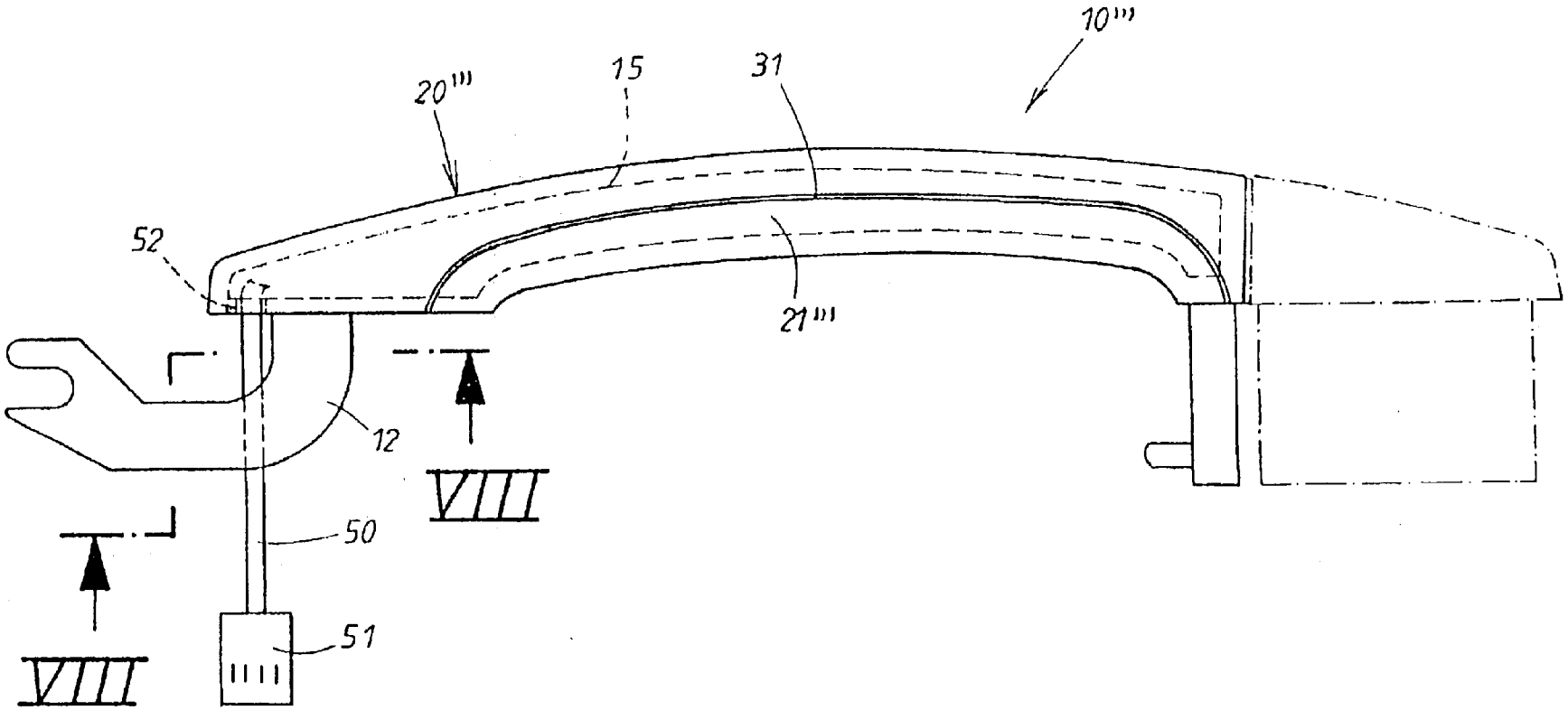
FIG. 7 for a single-shell embodiment of the invention according to FIG. 6 a plan view onto the handle in the viewing direction of arrow VII of FIG. 6.
Figure 9:
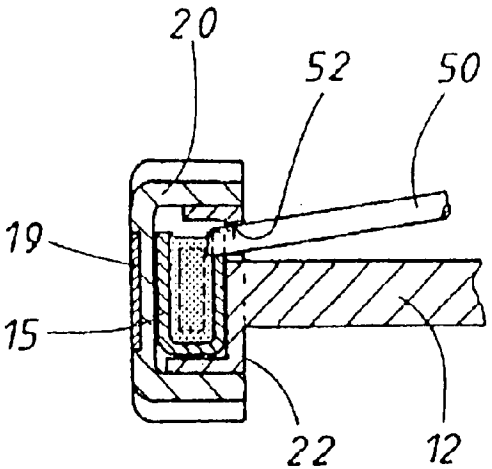
FIG. 9 a section according to IX—IX of FIG. 8.
Figure 8:
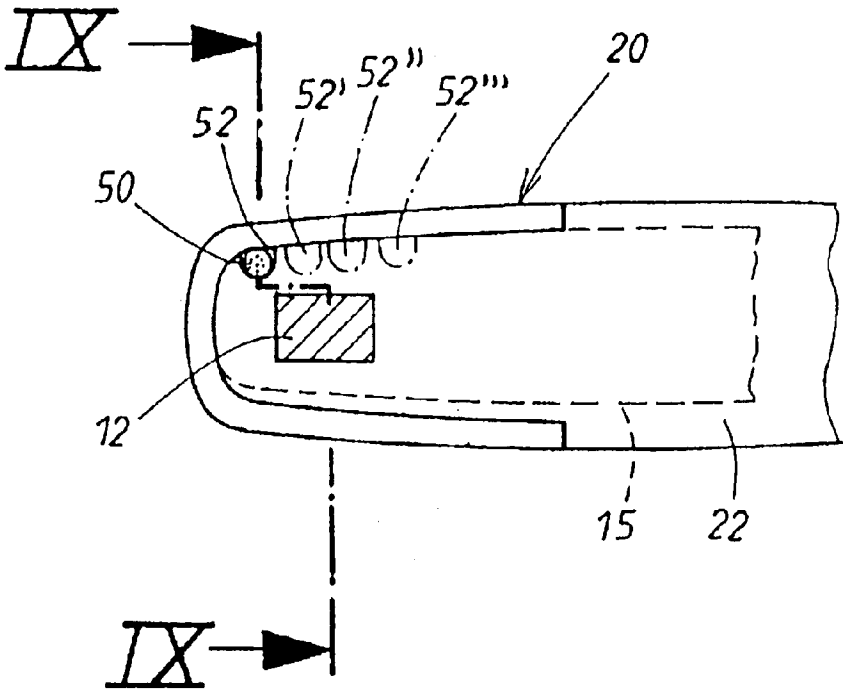
FIG. 8 a section according to VIII—VIII of FIG. 7 with the projection of a rearview of the front part of the handle.

In FIGS. 7 through 9 it is illustrated in which operation the exit of a cable 50 of the handle 10'" is arranged. This holds true also in an exemplary fashion for all further embodiments of the present invention. In the base shell 21'" of the handle 10'" in the area of the handle end 12 a penetration 52 is provided through which the cable 50, which extends from the container/carrier 15, is guided. This penetration could also be provided, for example, in the positions 52', 52", 52'". Also, several such penetrations 52, 52', 52", 52'" could be provided. When the handle is mounted on the door of the vehicle, the cable exit is covered and not visible to the user. The cable 50 is provided with a connecting plug 51 with which the electronic device, provided within the container 15, is connected to the electronic system of the vehicle.

List of Reference Numerals

10, 10' handle

10" alternative to 10 (FIG. 3)

10''' alternative to 10 (FIG. 6)
11, 11' handle end of 10 or 10'
12 handle end
13, 13' cylinder column at 10, 10'
14, 14' hollow space in 10 or 10'
15, 15' carrier for 16 or 16'
16, 16' electronic components, ferrite rod
17, 17' visible side of 10 or 10'
18, 18' contact seam between 21, 22 or 21', 22'
19, 19' decorative cover
20 C-shaped front strip on 10
20" front strip for 10" (FIG. 3)
20''' front strip for 10" (FIG. 6)
21, 21',21", 21''' U-shell, U-shaped base shell
22, 22' cover shell
23, 23' leg of 21 or 21'
23" leg of 21 at 10" (FIG. 3)
24, 24' snap connection between 23, 22 or 23', 22'
25 end sections of 20
25" end section of 20" (FIG. 3)
26 step-shaped recess in 21, 22
27 hook-shaped C-end of 20
27" end of 25"
28, 28' lower groove in 21, 21"
29 upper groove in 22
29' upper groove in 21'
contour of 10
shadow seam at 25
opening of 21 (FIG. 3)
opening of 21" (FIG. 6)
hollow of 25" (FIG. 3)
mounting arrow for 20" (FIG. 3)
snap connection of 36, 37
snap element of 35, tooth recess
counter snap element of 35, tooth projection
inner surface of 25" (FIG. 3)
bottom area of 21
leg end at end face of 23" (FIG. 3)
leading slant of 37
steep tooth flank of 37
mounting arrow of 20" (FIG. 3)
space in 21 (FIG. 3)
space in 21" (FIG. 6)
front section of 20'
potting compound
leg of 21" at 10'''
base of 21" at 10'''
cable
connecting plug
penetration
52", 52''' penetrations

What is claimed is:

1. External door handle for vehicles, comprised of a handle (10", 10''') arranged on the outer side of the door and being hollow at least partially, wherein the handle (10"; 10''') comprises at least one U-shaped shell (21; 21") whose U-space (44, 44') serves for receiving the electronic components (16), and wherein in the connected situation the U-shaped shell (21, 21''') is spanned at the visible side by a C-shaped front strip (20", 20''') and is anchored thereat, wherein the two C-end sections (25"; 25) of the front strip (20"; 20''') engage an additional circumferential area of the U-shaped shell (21"; 21''') from above or from below and the electronic components (16) are encapsulated water-tightly and are arranged in a carrier open at the top, the carrier being arranged within the handle formed of the U-shaped shell and the front strip.

2. External door handle according to claim 1, wherein the C-front strip (20") covers directly with one of its C-end sections (25") the upwardly facing U-shell opening (32) of the shell (21).

3. External door handle according to claim 1, wherein the U-shell opening (32') of the U-shaped shell (21''') is aligned relative to the front section (45) of the C-front strip (20''') and the front strip (20''') with its front section (45) covers directly the U-shell opening (32') of the shell (21''').

4. External door handle according to claim 2, wherein the two C-end sections (25") of the C-front strip (20") comprise a profiled snap element (36), such as a tooth recess (36), at their inner surface (38), respectively, and that this snap element in the connected situation engages a counter snap element, such as a tooth projection (37), provided on the shell.

5. External door handle according to claim 1, wherein the C-front strip (20"; 20''') has substantially parallel extending C-end sections (25, 25")and that, for realizing a connection, the C-end sections (25, 25") can be snapped into place on the shell (21; 21''') by means of a lateral sliding assembly (34) of the C-front strip (20").

6. External door handle according to claim 4, wherein the snap element or counter snap element (36, 37) has a tooth profile and that the tooth profile on its tooth flank active in the connecting sliding direction (34) of the C-front strip (20") has a leading slant (41) for the C-end sections (25") while in the counter direction (43) a steep tooth flank (42) is provided.

7. External door handle according to claim 1, wherein the handle (10) is a two-part (21, 22) combination of a U-shaped base shell (21) and a cover shell (22) connected with the U-legs (23) of the base shell, wherein between the two shells (21, 22) in the connected situation a contact seam (18) results at the visible side and the hollow space (14) between the two shells (21, 22) serves for receiving the electronic components (16), wherein the C-end sections (25) of the front strip (20) have hook-like angled C-ends (27), wherein in the connected situation, the two shells (21, 22) are spanned at the visible side by the front strip (20), wherein the two C-end sections (25) of the front strip (20) engage from above or from below a circumferential area of the shells (21, 22), respectively, and are arranged in an upper groove (29) of the cover shells (22) and a lower groove (28) of the base shell (21) in a sunk arrangement.

8. External door handle according to claim 7, wherein the base and the cover shells (21, 22) in the area of engagement from above or below of the front strip (20) have stepped recesses (26) and that these recesses (26) end at the upper groove (29) and the lower groove (28).

9. External door handle according to claim 1, wherein in the mounted situation the front strip (20, 20", 20''') with its contour (30) has a flush transition into the shells (21, 22) or the shell (21, 21''').

10. External door handle according to claim 1, wherein the front strip (20; 20", 20''') itself is provided at the visible side with a let-in decorative cover (19).

11. External door handle according to claim 1, wherein the carrier for the electronic components (16) is a container (15) having six sides, wherein five of the six sides are and wherein one of the six sides is open and faces upwardly after mounting in the handle (10, 10", 10''').

12. External door handle according to claim 11, wherein the container (15) is manufactured of hard plastic material.

* * * * *